US006204744B1

(12) United States Patent
Shafer et al.

(10) Patent No.: US 6,204,744 B1
(45) **Date of Patent: *Mar. 20, 2001**

(54) HIGH CURRENT, LOW PROFILE INDUCTOR

(75) Inventors: Timothy M. Shafer; Brett W. Jelkin, both of Yankton, SD (US)

(73) Assignee: Vishay Dale Electronics, Inc., Columbus, NE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/963,224

(22) Filed: Nov. 3, 1997

Related U.S. Application Data

(63) Continuation of application No. 08/503,655, filed on Jul. 18, 1995, now abandoned.

(51) Int. Cl.[7] ..... H01F 27/02; H01F 5/00

(52) U.S. Cl. ..... 336/83; 336/90; 336/200; 336/96

(58) Field of Search ..... 336/200, 96, 233, 336/223, 83, 90; 333/81 R

(56) References Cited

U.S. PATENT DOCUMENTS

| | | | | |
|---|---|---|---|---|
| 1,994,534 | | 3/1935 | Robinson . | |
| 2,118,291 | * | 5/1938 | Bollman | 336/233 |
| 2,391,563 | * | 12/1945 | Goldberg | 336/233 |
| 2,457,806 | | 1/1949 | Crippa . | |
| 2,850,707 | * | 9/1958 | Wroblewski et al. | 336/83 |
| 2,966,704 | * | 1/1961 | O'Brian et al. | 336/83 |
| 3,201,729 | * | 8/1965 | Blanchi et al. | 336/83 |
| 3,235,675 | * | 2/1966 | Blume | 336/83 |
| 3,255,512 | * | 6/1966 | Lochner et al. | 336/83 |
| 3,380,004 | * | 4/1968 | Hansen | 336/83 |
| 3,554,797 | * | 1/1971 | Coeruer, Jr. et al. | 336/83 |
| 3,678,345 | | 7/1972 | Hvidtfeldt et al. . | |
| 4,146,854 | * | 3/1979 | Ishino et al. | 333/81 R |
| 4,543,554 | * | 9/1985 | Muellenheim et al. | 336/96 |
| 4,696,100 | * | 9/1987 | Yamamoto et al. | 336/233 |
| 5,359,311 | * | 10/1994 | Kawabata et al. | 336/200 |

FOREIGN PATENT DOCUMENTS

| | | | | |
|---|---|---|---|---|
| 179 582 | | 9/1935 | (CH) . | |
| 364 451 | | 11/1922 | (DE) . | |
| 1 370 019 | | 3/1938 | (DE) . | |
| 2132378 | * | 1/1973 | (DE) | 336/83 |
| 28 11 227 | | 9/1978 | (DE) . | |
| 40 23 141 | | 1/1992 | (DE) . | |
| 55-77113 | * | 6/1980 | (JP) | 336/83 |
| 55-77113 | | 10/1980 | (JP) . | |
| 58-188108 | * | 11/1983 | (JP) | 336/83 |
| 59-185809 | | 12/1984 | (JP) . | |
| 60-034008 | | 2/1985 | (JP) . | |
| 63-79306 | * | 4/1988 | (JP) | 336/83 |
| 1-266705 | | 10/1989 | (JP) . | |
| 1-167011 | | 11/1989 | (JP) . | |
| 4-373112 | * | 12/1992 | (JP) | 336/83 |
| 5-283238 | * | 10/1993 | (JP) | 336/200 |
| WO 92/05568 | * | 4/1992 | (WO) | 336/83 |

* cited by examiner

*Primary Examiner*—Anh Mai
(74) *Attorney, Agent, or Firm*—Zarley, McKee, Thomte, Voorhees & Sease

(57) ABSTRACT

A high current, low profile inductor includes a wire coil having an inter coil end and an outer coil end. A magnetic material completely surrounds the wire coil to form an inductor body. First and second leads connected to the inner coil end and the outer coil end respectively extend through the magnetic material to the exterior of the inductor body. The method of operation involves pressure molding the magnetic material around the wire coil.

12 Claims, 4 Drawing Sheets

HIGH CURRENT, LOW PROFILE INDUCTOR

This is a continuation of U.S. Ser. No. 08/503,655 filed Jul. 18, 1995, now abandoned.

BACKGROUND OF THE INVENTION

The present invention relates to a high current, low profile inductor and method for making same.

Inductors of this type are referred to by the designation IHLP which is an abbreviation for "inductor, high current, low profile."

Most prior art inductive components are comprised of a magnetic core having a C-shape, and E-shape, a toroidal shape, or other shapes and configurations. Conductive wire coils are then wound around the magnetic core components to create the inductor. These types of prior art inductors require numerous separate parts, including the core, the winding, and some sort of structure to hold the parts together. Also, these inductive coils often have a shell surrounding them. As a result there are many air spaces in the inductor which affect its operation and which prevents the maximization of space.

Therefore, a primary object of the present invention is the provision of an improved high current, low profile inductor and method for making same.

A further object of the present invention is the provision of a high current, low profile inductor which has no air spaces in the inductor, and which includes a magnetic material completely surrounding the coil.

A further object of the present invention is the provision of an improved high current, low profile inductor which includes a closed magnetic system which provides a self shielding capability.

A further object of the present invention is the provision of an improved high current, low profile inductor which maximizes the utilization of the space needed for a given inductance performance so that the inductor can be of a minimum size. A further object of the present invention is the provision of an improved inductor which is smaller, less expensive to manufacture, and is capable of accepting more current without saturating than previous inductance coils.

A further object of the present invention is the provision of a high current, low profile inductor which requires fewer turns of wire in the coil to achieve the same inductance achieved with larger prior art inductors, thus lowering the series resistance of the inductor.

SUMMARY OF THE INVENTION

The foregoing objects may be achieved by a high current, low profile inductor which includes a wire coil having an inner coil end and an outer coil end. A magnetic material completely surrounds the wire coil to form an inductor body. A first lead is connected to the inner coil end of the coil and extends through the magnetic material to a first lead end exposed outside the inductor body. A second lead is connected to the outer coil and extends through the magnetic material to a second lead end exposed outside the inductor body.

The method for making the inductor comprises forming a wire coil having an inner coil end and an outer coil end. A first lead is attached to the inner coil end of the coil. The coil is then wound into a helical spiral. Then a second lead is attached to the outer coil end. The first and second leads each have first and second free ends. Next a powdered magnetic material is pressure molded completely around the coil so as to create an inductor body. The free ends of the first and second leads extend outside the inductor body.

DETAILED DESCRIPTION OF THE PREFERRED EMBODIMENT

Figure 1:
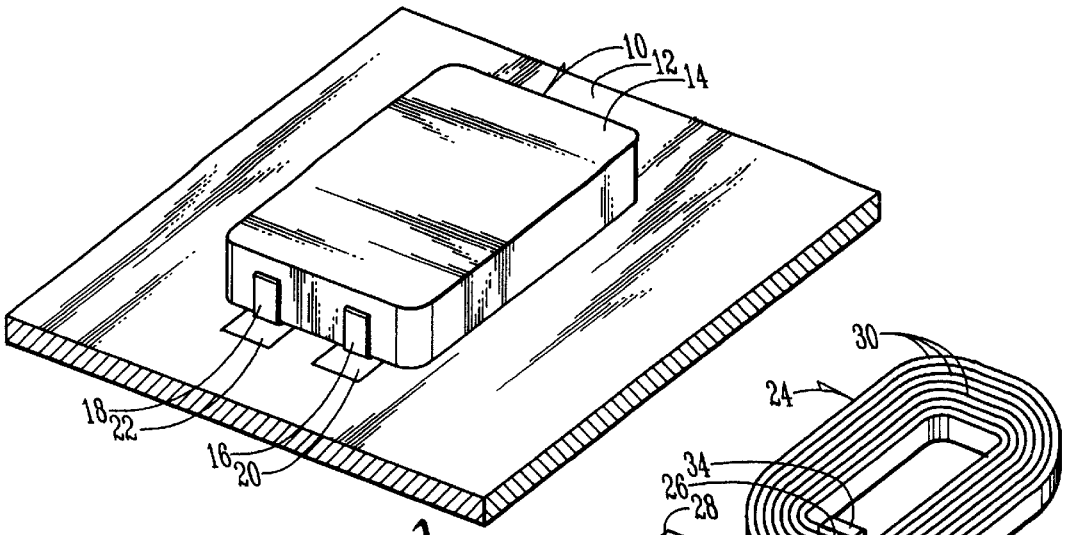
FIG. 1 is a pictorial view of an inductor constructed in accordance with the present invention and mounted upon a circuit board.

Referring to the drawings the numeral 10 generally designates the high current, low profile inductor (IHLP) of the present invention. IHLP 10 is shown in FIG. 1 to be mounted on a circuit board 12. IHLP 10 includes an inductor body 14 having a first lead 16 and a second lead 18 extending outwardly therefrom. The leads 16 and 18 are bent and folded under the bottom of the inductor body 14 and are shown soldered to a first pad and a second pad 20, 22 respectively.

Figure 2:
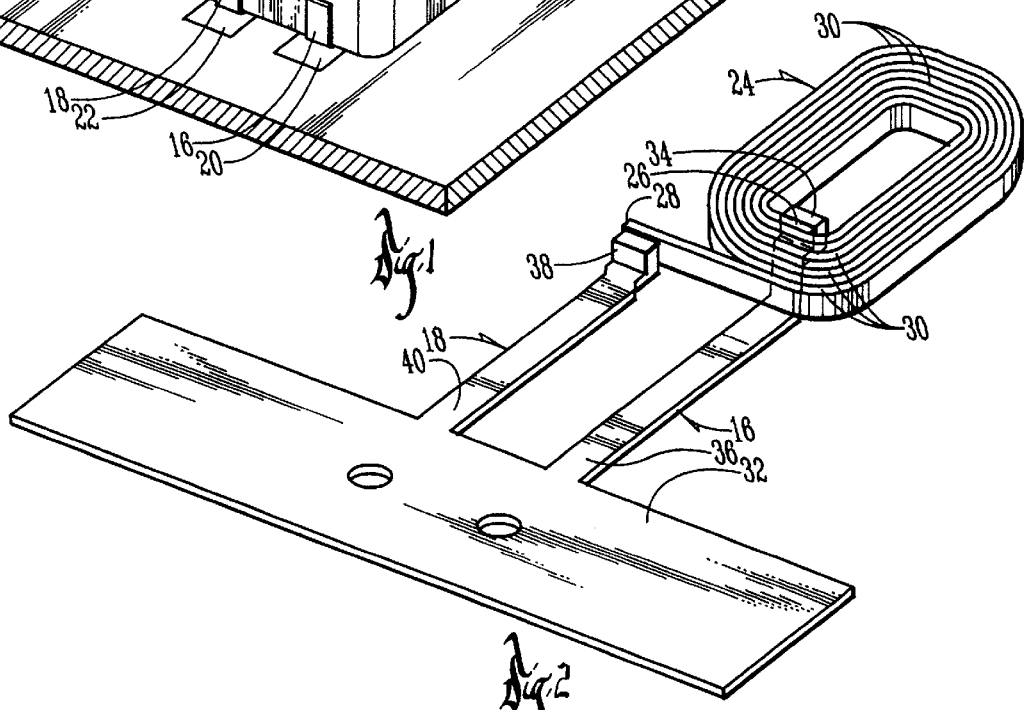
FIG. 2 is a pictorial view of the coil of the inductor and the lead frame which is attached to the coil before the molding process.

Referring to FIG. 2 the inductor 10 is constructed by forming a wire coil 24 from a flat wire having a rectangular cross section. An example of a preferred wire for coil 24 is an enameled copper flat wire manufactured by H.P. Reid Company, Inc., 1 Commerce Boulevard, P.O. Box 352 440, Palm Coast, Fla. 32135, the wire is made from OFHC Copper 102, 99.95% pure. A polymide enamel, class 220, coats the wire for insulation. An adhesive, epoxy coat bound "E" is coated over the insulation. The wire is formed into a helical coil, and the epoxy adhesive is actuated by dropping acetone on the coil. Activation of the epoxy can also be done by heating the coil. Activation of the adhesive causes the coil to remain in its helical configuration without loosening or unwinding.

Coil 24 includes a plurality of turns 30 and also includes an inner end 26 and an outer end 28.

A lead frame 32 formed of phosphor bronze, 510 alloy, which is one half hardened, includes first lead 16 which has one end 34 welded to the inner end 26 of coil 24. Lead frame 32 also includes a second lead 18 which has one end 38 welded to the outer end 28 of coil 24. Leads 16 and 18 include free ends 36, 40 which are shown to be attached to the lead frame 32 in FIG. 2. The welding of ends 34, 38 to the inner end 26 and the outer end 28 of coil 24 is preferably accomplished by a resistance welding, but other forms of soldering or welding may be used.

Figure 5A:
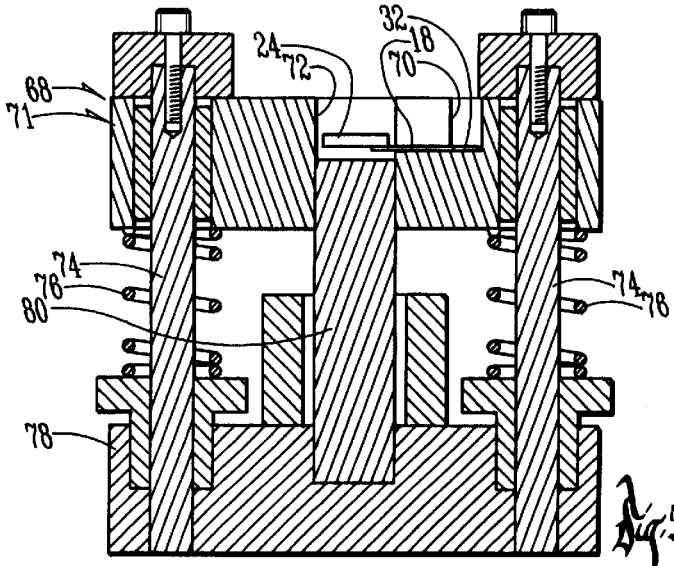
FIG. 5*a* is a sectional view of the lead frame and coil mounted in a press.
Figure 5B:
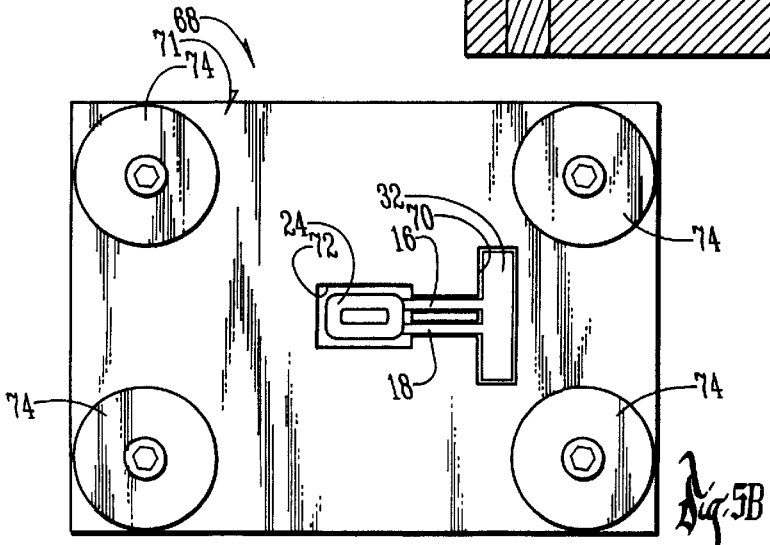
FIG. 5*b* is a top plan view of FIG. 5*a*.

Referring to FIGS. 5*a* and 5*b*, a pressure molding machine 68 includes a platten 71 having a T-shaped lead frame holder 70 in communication with a rectangular die 72. Platten 71 is slidably mounted for vertical sliding movement on slide posts 74 and is spring mounted on those posts 74 by means of springs 76. A base 78 includes a stationary punch 80 which projects upwardly into the rectangular die 72 as shown in FIG. 5*a*.

The lead frame and coil assembly shown in FIG. 2 is placed in the T-shaped lead frame holder 70 as shown in FIGS. 5*a* and 5*b*. In this position the coil is spaced slightly above the upper end of stationary punch 80.

Figure 5C:
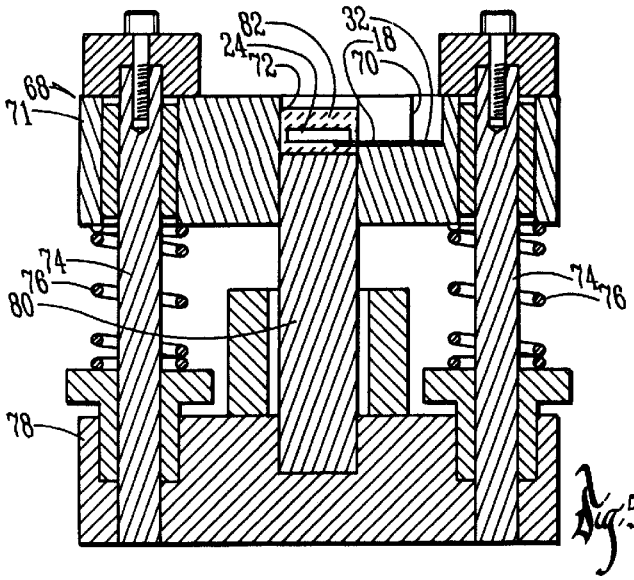
FIG. 5*c* is a view similar to FIG. 5*a*, but showing the powder surrounding the lead frame and coil before pressure is applied.
Figure 5D:
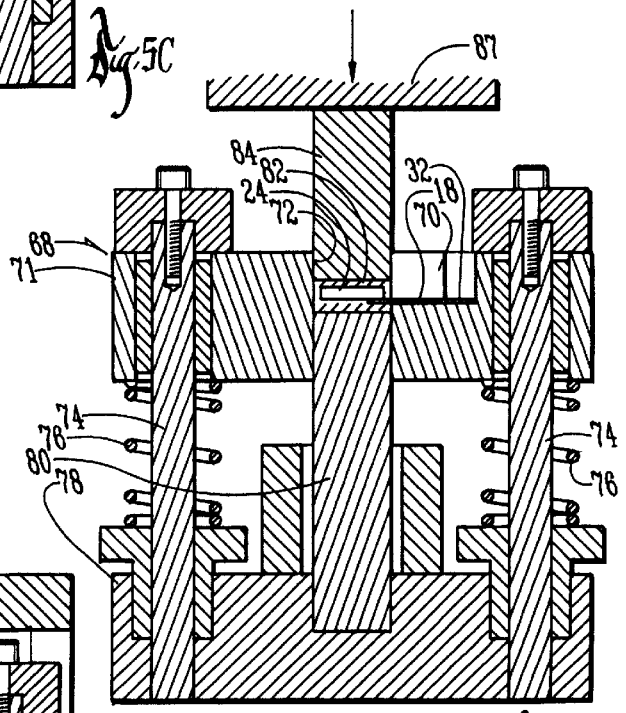
FIG. 5*d* is a view similar to 5*a*, but showing the pressure being applied to the coil, lead frame, and powder.

Referring to FIG. 5*c* a powdered molding material 82 is poured into the die 72 in such a manner as to completely surround the coil 24. The leads 16, 18 extend outwardly from the powdered material 82 where they are connected to the lead frame 32.

The magnetic molding material is comprised of a first powdered iron, a second powdered iron, a filler, a resin, and a lubricant. The first and second powdered irons have differing electrical characteristics that allow the device to have a high inductance yet low core losses so as to maximize its efficiency. Examples of preferred powdered irons to use in this mixture are as follows: a powdered iron manufactured by Hoeganaes Company, River Road and Taylors Lane, Riverton, N.J., under the trade designation Ancorsteel 1000C. This 1000 C material is insulated with 0.48% mass fraction with 75% $H_3P04$. The second powdered material is manufactured by BASF Corporation, 100 Cherryhill Road, Parsippany, N.J. under the trade designation Carbonyl Iron, Grade SQ. This SQ material is insulated with 0.875% mass fraction with 75% $H_3P04$.

The powdered magnetic material also includes a filler, and the preferred filler is manufactured by Cyprus Industrial Minerals Company, Box 3299, Ingelwood, Calif. 80155 under the trade designation Snowflake PE. This is a calcium carbonate powder.

A polyester resin is also added to the mixture, and the preferred resin for this purpose is manufactured by Morton International, Post Office Box 15240, Reading, Pa. under the trade designation Corvel Flat Black, Number 21-7001.

In addition a lubricant is added to the mixture. The lubricant is a zinc stearate manufactured by Witco Corporation, Box 45296, Huston Tex. under the product designation Lubrazinc W.

Various combinations of the above ingredients may be mixed together, but the preferred mixture is as follows:

1,000 grams of the first powdered iron.

1,000 grams of the second powdered iron.

36 grams of the filler.

74 grams of the resin.

0.3% by weight of the lubricant.

The above materials (other than the lubricant) are mixed together and then acetone is added to wet the material to a mud-like consistency. The material is then permitted to dry and is screened to a particle size of −50 mesh. The lubricant is then added to complete the material 82. The material 82 is then added to the die 72 as shown in FIG. 5*c*.

The next step in the process involves the forcing of a movable ram 87 downwardly onto the removable punch 84 so as to force the punch 84 into the die 72. The force exerted by the removable punch 84 should be approximately 15 tons per square inch to 20 tons per square inch. This causes the powdered material 82 to be compressed and molded tightly completely around the coil so as to form the inductor body 14 shown in FIG. 1 and in FIG. 5*e*.

Figure 3:
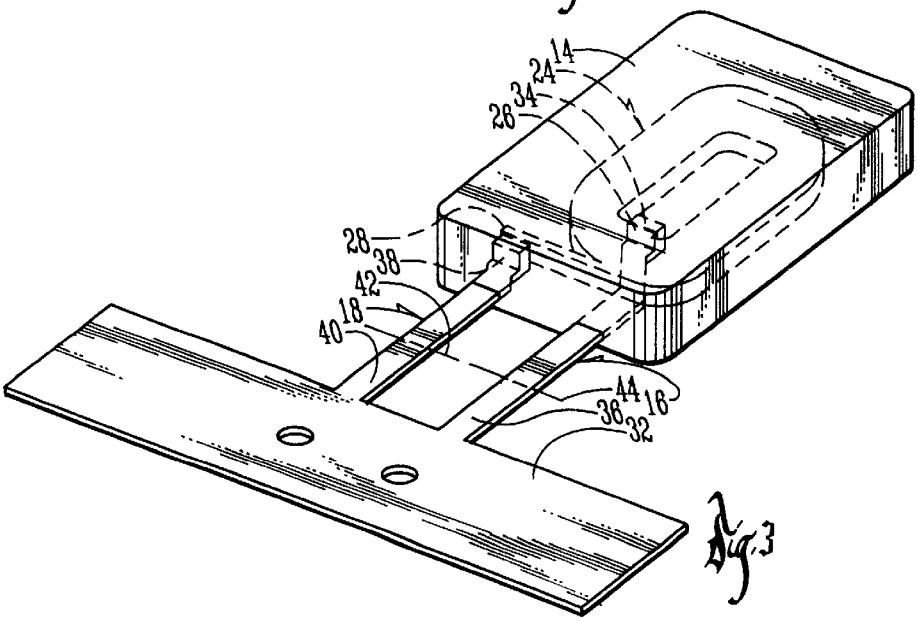
FIG. 3 is a pictorial view of the inductor of the present invention after the molding process is complete, but before the lead frame is severed from the leads.
Figure 5E:
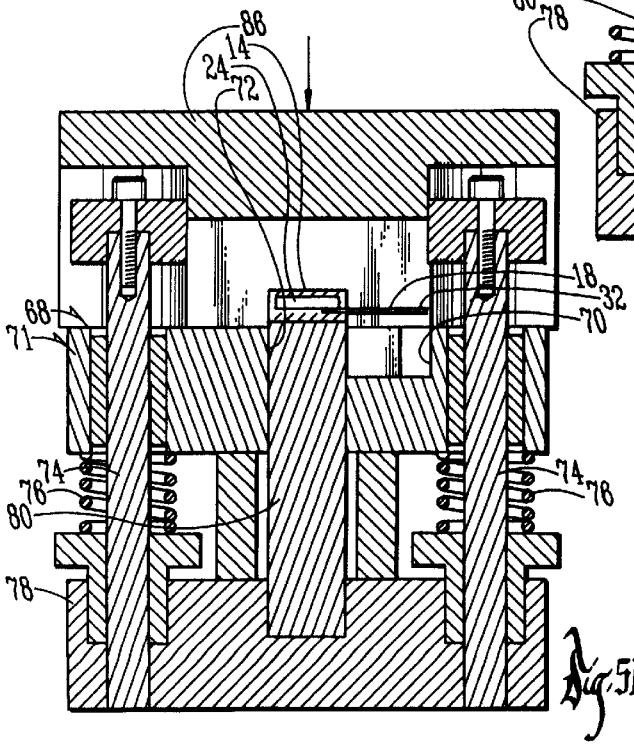
FIG. 5*e* is a view similar to 5*a*, but showing the ejection of the lead frame and the molded inductor from the mold.

Referring to FIG. 5*e* an ejection ram 86 is lowered on to platten 71 so as to force platten 71 downwardly against the bias of springs 76. This causes the stationary ram 80 to eject the molded assembly from the die 72. At this stage of the production the molded assembly is in the form which is shown in FIG. 3. The molded assemblies are then baked at 325° F. for one hour and forty-five minutes to set the polyester resin.

The next step in the manufacturing process is to severe the lead frame 32 from the leads 16, 18 along the cut lines 42, 44. The leads 16, 18 are then bent downwardly and inwardly so as to be folded against the bottom surface of the inductor body 14.

Figure 4:
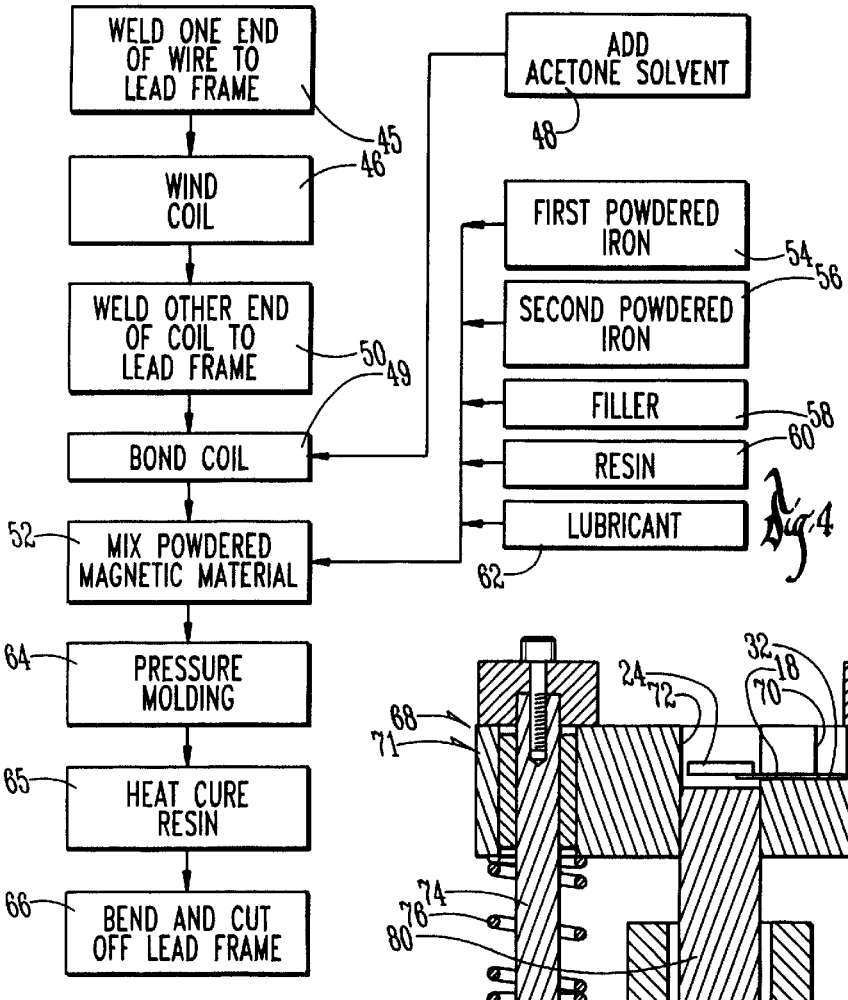
FIG. 4 is a flow diagram showing the method for constructing the inductor of the present invention.

The various steps for forming the inductor are shown in block diagram in FIG. 4. Initially one of the wire ends 26, 28 is welded to its corresponding end 34,36 of leads 16, 18 as represented by block 45. Next the coil is wound into a helix as shown by block 46. Block 50 represents the step of welding the other end 26, 28 to its corresponding lead 16, 18. The coil wire includes an epoxy coat of bonding material described above. A bonding step 49 is achieved by applying the acetone 48 or heat to cause the bonding material to bind or adhere the various turns 30 of coil 24 together.

Next, at step 52 the powdered magnetic material is mixed together adding ingredients 54, 56, 58, 60, and 62.

The pressure molding step 64 involves the application of pressure as shown in FIGS. 5*a* through 5*e*. The parts are then heated to cure the resin as shown in box 65.

Finally after the curing is complete the bending and cutting step involves cutting off the lead frame 24 and folding the leads 16, 18 against the bottom surface of the inductor body 14.

When compared to other inductive components the IHLP inductor of the present invention has several unique attributes. The conductive winding, lead frame, magnetic core material, and protective enclosure are molded as a single integral low profile unitized body that has termination leads suitable for surface mounting. The construction allows for maximum utilization of available space for magnetic performance and is magnetically self shielding.

The unitary construction eliminates the need for two core halves as was the case with prior art E cores or other core shapes, and also eliminates the associated assembly labor.

The unique conductor winding of the present invention allows for high current operation and also optimizes magnetic parameters within the inductor's footprint.

The manufacturing process of the present invention provides a low cost, high performance package without the dependence on expensive, tight tolerance core materials and special winding techniques.

The magnetic core material has high resistivity (exceeding 3 mega ohms) that enables the inductor as it is manufactured to perform without a conductive path between the surface mount leads. The magnetic material also allows efficient operation up to 1 MHz. The inductor package performance yields a low DC resistance to inductance ratio of two milliOhms per microHenry. A ratio of 5 or below is considered very good.

Figure 6:
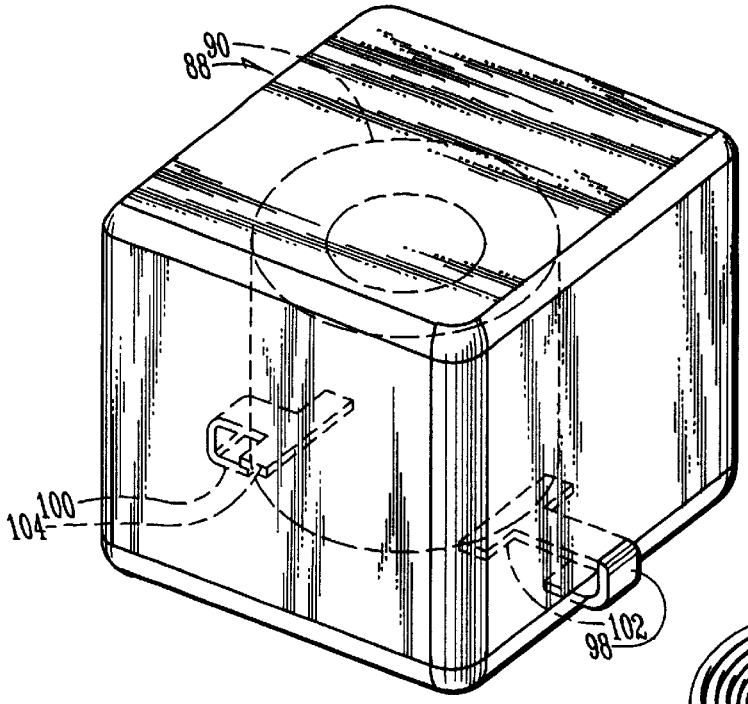
FIG. 6 is a perspective view of a modified form of the invention utilizing a coil of wire having a round cross section.
Figure 7:
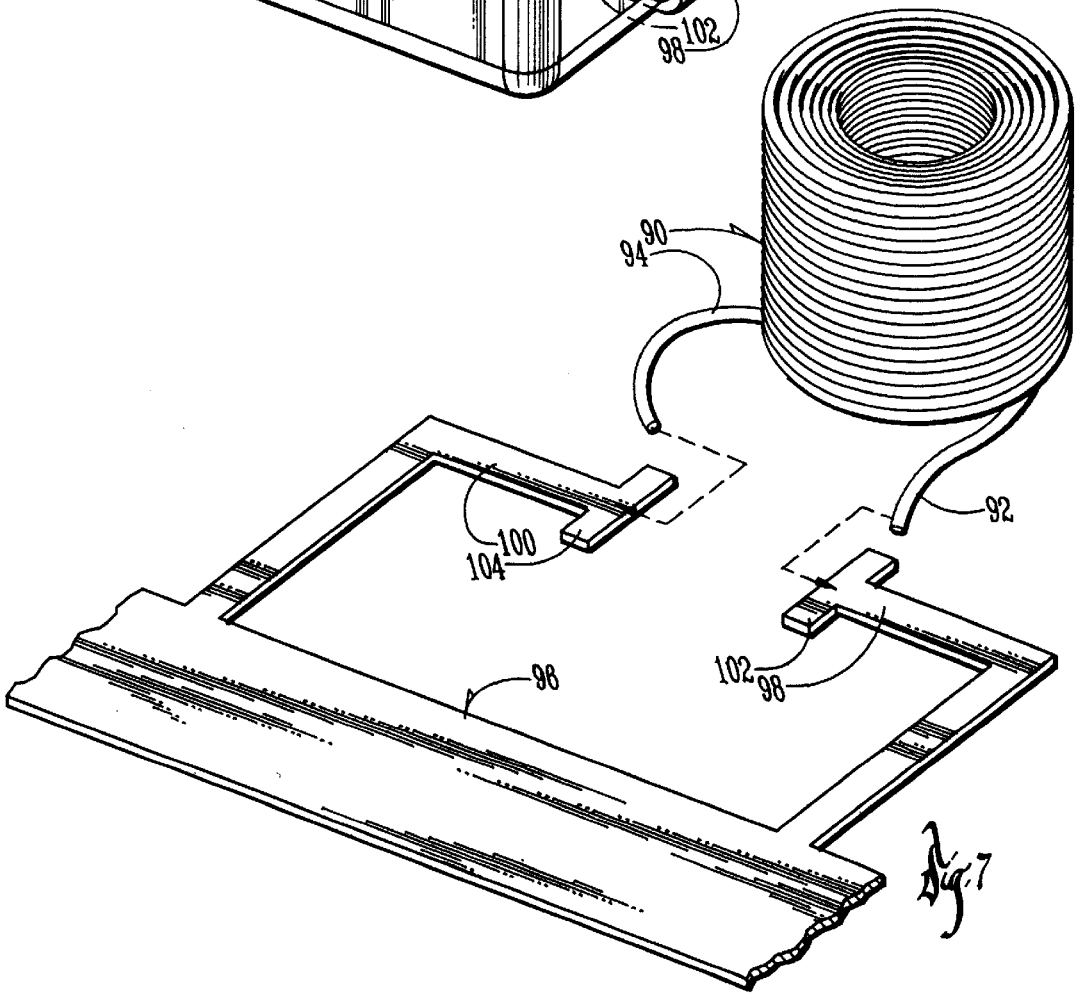
FIG. 7 is an exploded perspective view of the lead frame and coil of the device of FIG. 6 before assembly.

Referring to FIGS. 6 and 7 a modified form of the invention is designated by the numeral 88. Inductor 88 is formed from a coil 90 of wire having round cross section.

The coil 90 includes a first coil end 92 and a second coil end 94. A lead frame 96 includes a first lead 98 and a second lead 100 having first and second lead ends 102, 104.

The method of assembly of device 90 is different from the device 10 shown in FIGS. 1–5. With device 90, the coil is wound first and is heat bonded during winding. Then the coil ends 92, 94 are welded to the lead ends 102, 104 respectively. The mixed powdered material is then applied and the pressure molding process is accomplished in the same fashion as described before. Finally the leads 98, 100 are cut off and bent downwardly under the bottom of the device 10.

The position of the leads 98, 100 can be varied without detracting from the invention. Also, it is possible to put more than one coil within a molded part. For example, it would be possible to put two or more coils 24 within the molded body 10 or two or more coils 90 within the molded body 88.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A high current, low profile inductor (IHLP) comprising:

a conductive coil having an inner coil end, an outer coil end, a plurality of coil turns, and a hollow core;

a first conductive lead connected to said inner coil end;

a second conductive lead connected to said outer coil end;

an inductor body substantially free from ferrite materials and comprising a uniform mixture of first and second powdered iron particles, said first powdered iron particles and said second powdered iron particles having electrical characteristics different from one another;

said uniform mixture of said first and second iron particles completely surrounding and contacting all of said conductive coil and portions of said first and second conductive leads, and also completely filling said hollow core;

said first and second iron particles being pressure molded within said hollow core and around said conductive coil and said portions of said first and second leads so that said first and second powdered iron particles of said inductor body are substantially free from voids therein and are compressed tightly completely around and in contact with all portions of said conductive coil and said portions of said first and second leads without shorting out said coil or said leads.

2. A high current low profile inductor (IHLP) according to claim 1 wherein said uniform mixture of said inductor body further comprises a filler.

3. A high current low profile inductor (IHLP) according to claim 2 wherein said uniform mixture of said inductor body further comprises a resin.

4. A high current low profile inductor (IHLP) according to claim 3 wherein said uniform mixture of said inductor body further comprises a lubricant.

5. A high current low profile inductor (IHLP) according to claim 4 wherein said uniform mixture of said inductor body is comprised of the following approximate weight ratios: 1,000 grams each of said first and second powdered iron particles; 36 grams of said filler; 74 grams of said resin; and 0.3% by weight of said lubricant.

6. A high current low profile inductor (IHLP) according to claim 1 wherein said conductive coil includes an insulative coating thereon.

7. A high current low profile inductor (IHLP) according to claim 6 wherein said conductive coil further includes an adhesive materiel coated over said insulative coating for holding said conductive coil in a predetermined helical shape.

8. A high current low profile inductor (IHLP) according to claim 7 wherein said insulation material comprises $H_3PO_4$.

9. A high current low profile inductor (IHLP) according to claim 1 wherein said inductor body is formed by the process of applying compressive forces of from 15 to 20 tons per square inch to said uniform mixture during said compressing step.

10. A high current, low profile inductor (IHLP) comprising:

a conductive coil having an inner coil end, an outer coil end, a plurality of coil turns, and a hollow core;

a first conductive lead connected to said inner coil end;

a second conductive-lead connected to said outer coil end;

an inductor body substantially free from ferrite materials and comprising powdered iron particles;

said powdered iron materials completely surrounding and contacting all of said conductive coil and portions of said first and second conductive leads, and also completely filling said hollow core;

said powdered iron materials being pressure molded within said hollow core and around said conductive coil and said portions of said first and second leads so that said powdered iron particles of said inductor body are substantially free from voids therein and are compressed tightly completely around and in contact with all portions of said conductive coil and with said portions of said first and second leads without shorting out said coil or said leads.

11. A high current low profile inductor (IHLP) according to claim 10 and wherein said iron particles are in a uniform mixture comprising a filler, a resin, and a lubricant.

12. A high current low profile inductor (IHLP) according to claim 11 wherein said inductor body is formed by pressure molding of said powdered iron materials under compressive forces of from 15 to 20 tons per square inch.

* * * * *